United States Patent [19]

Briscoe

[11] 4,079,888

[45] Mar. 21, 1978

[54] HEAT RECOVERY SYSTEM FOR FORCED AIR FURNACES

[76] Inventor: Harry H. Briscoe, Rte. 10, Burnett Ferry Rd., Rome, Ga. 30161

[21] Appl. No.: 770,781

[22] Filed: Feb. 22, 1977

Related U.S. Application Data

[63] Continuation of Ser. No. 569,464, Apr. 18, 1975, abandoned.

[51] Int. Cl.[2] ..... F24B 7/02

[52] U.S. Cl. ..... 237/55; 165/164; 165/DIG. 2

[58] Field of Search ..... 165/DIG. 2, 129, 130, 165/159, 164; 126/117; 237/55

[56] References Cited

U.S. PATENT DOCUMENTS

| | | | |
|---|---|---|---|
| 2,084,408 | 6/1937 | Mueller | 165/DIG. 2 |
| 2,102,581 | 12/1937 | McNeish | 165/164 X |
| 2,768,814 | 10/1956 | Frey et al. | 165/159 X |
| 3,209,744 | 10/1965 | Ayres et al. | 126/113 |
| 3,944,136 | 3/1976 | Huie | 237/55 |

*Primary Examiner*—William E. Wayner
*Assistant Examiner*—William E. Tapolcai, Jr.
*Attorney, Agent, or Firm*—Newton, Hopkins & Ormsby

[57] ABSTRACT

A heat recovery system is disclosed for a forced air furnace having a flue through which combusted gases may be exhausted, a series of air ducts connected with the furnace, and a blower for forcing air through the series of air ducts and furnace. The heat recovery system comprises a heat exchanger having one passageway coupled with the flue and another passageway coupled with the series of air ducts across the blower in heat transfer relation with the one passageway.

5 Claims, 6 Drawing Figures

HEAT RECOVERY SYSTEM FOR FORCED AIR FURNACES

This is a continuation, of application Ser. No. 569,464, filed Apr. 18, 1975, now abandoned.

BACKGROUND OF THE INVENTION

This invention relates to heat recovery systems for forced air furnaces fueled by combustible fuels such as natural gas, propane, butane and fuel oil.

Most commercial and home forced air furnaces operate at only some 65% to 75% efficiency. This relatively poor efficiency is due in large part to the loss of heat conducted out of the home by the flue gases eminating from the furnace. In an attempt to recover this heat loss heat exchangers have heretofore been mounted within the furnace flues through which exchanges ambient home air is drawn and then channeled to the furnace air return duct to preheat the intake air. Such heat recovery systems are exemplified by those illustrated in U.S. Pat. Nos. 1,586,228, 2,265,501 and 2,738,785. A variation of this type system is disclosed in U.S. Pat. No. 2,362,940 wherein air is routed from the heat exchanger mounted within the furnace flue back to the home rooms themselves rather than to the furnace return air duct.

These early attempts to recover heat losses from escaping flue gases have not met with substantial success. Perhaps the foremost reason for this lack of success is attributable to the relatively small amount of heat transferred to the air passing through the exchangers to the furnace. This in turn has been occasioned in large part by the relatively slow flow of air drawn by the furnace blower back into the heating system through the heat exchanger. In attempts to increase this flow the heat exchangers have been provided with auxiliary blowers as disclosed in U.S. Pat. Nos. 2,468,909, 3,124,197 and 3,813,039. The addition of such auxiliary blowers itself, however, creates an overall decrease in energy economization due to that consumed in operating the blower plus the attendant cost of manufacture, installation and service. Furthermore, the heat exchangers themselves have been of relatively complex and costly design as well as expensive and difficult to incorporate into preinstalled furnace flues.

Accordingly, it is a general object of the present invention to provide an improved heat recovery system for forced air furnaces fueled by combustible fuels such as gas and oil.

More specifically, it is an object of the present invention to provide an improved system for recovering heat losses in flue gasses emanating from forced air furnaces.

Yet another object of the invention is to provide a heat exchanger of improved construction for utilization in a heat recovery system of the type described.

Yet another object of the invention is to provide a heat recovery system of the type described with improved air flow without requiring the use of a blower auxiliary to that employed by the forced air furnace itself.

SUMMARY OF THE INVENTION

In one form of the invention a heat recovery system is provided for a forced air furnace having a flue through which combusted gases may be exhausted, a series of air ducts connected with the furnace, and a blower for forcing air through a series of air ducts and furnace. The heat recovery system comprises a heat exchanger having one passageway coupled with the flue and another passageway coupled with the series of air ducts across the blower in heat transfer relation with the one passageway.

DETAILED DESCRIPTION OF THE DRAWING

Figure 1:
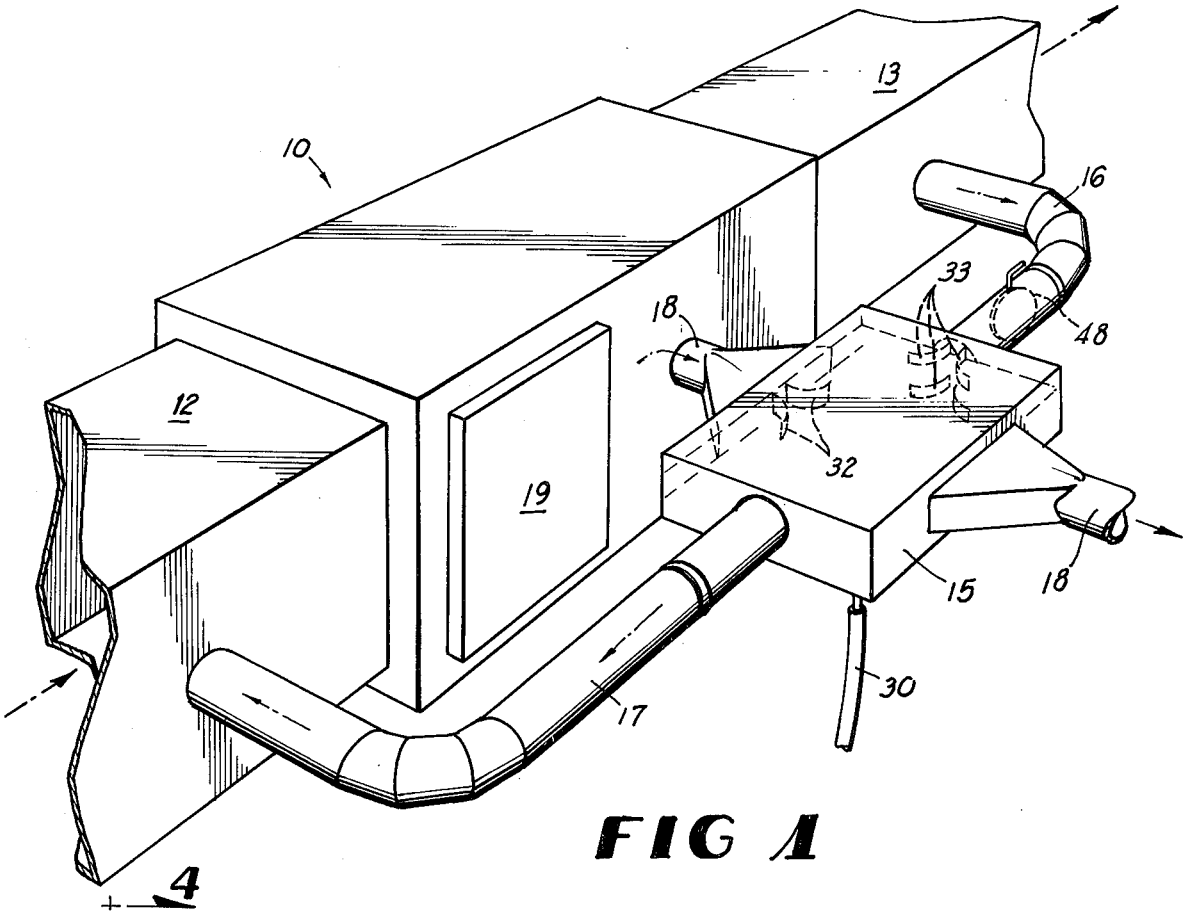
FIG. 1 is a perspective view of a heat recovery system embodying principles of the invention in one preferred form.

Referring now in more detail to the drawing, there is shown in FIG. 1 a gas furnace 10 to which a series of air ducts communicate including a return air duct 12 and a supply air duct 13. A heat exchanger 15 is seen to be mounted horizontally beside the furnace by means of a set of mutually coplanar conduits including a conduit 16 extending between supply air duct 13 and the exchanger, a conduit 17 extending between return air duct 12 and the exchanger, and a flue 18.

The furnace itself is conventionally provided with air filters such as 19 and a blower 20. With this arrangement conduits 16 and 17 are seen to straddle blower 20 which upon energization forces air heated by the furnace through conduits 16 and 17 and heat exchanger 15 as shown by the arrows simultaneously with the passage of high temperature flue gases through flues 18 and the exchanger as also shown by arrows.

Figure 2:
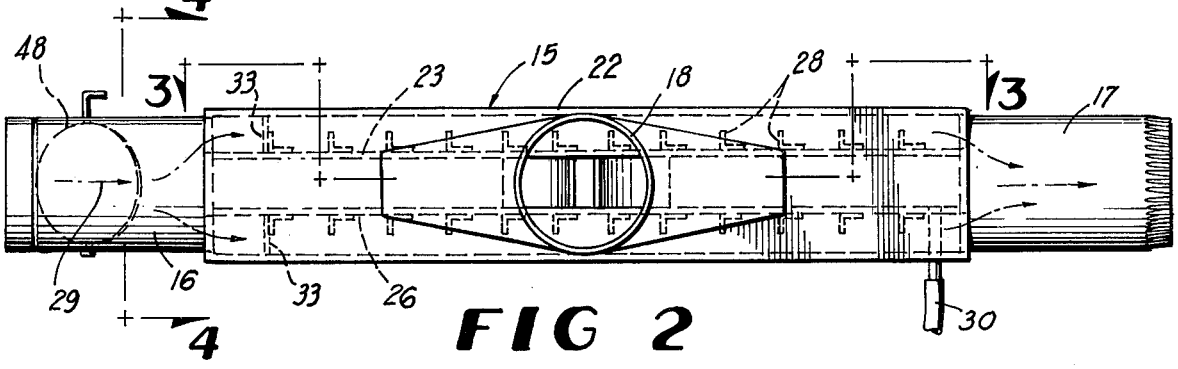
FIG. 2 is a side elevational view of the heat exchanger component of the system depicted in FIG. 1.
Figure 3:
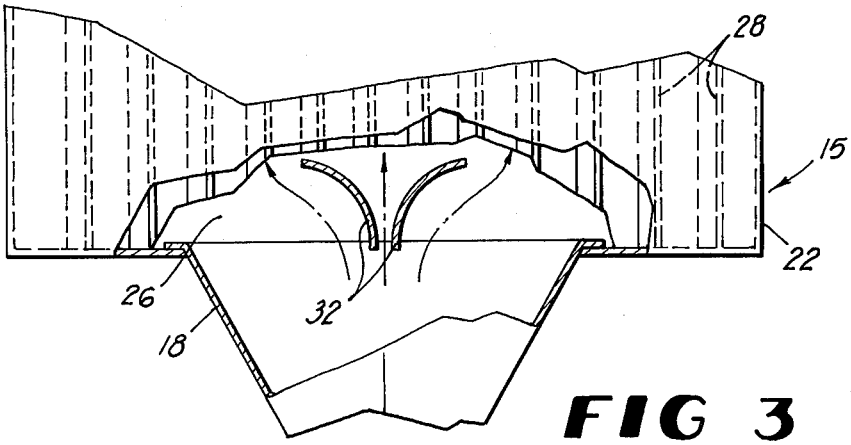
FIG. 3 is a fragmentary plan view, partially in cross-section, of the heat exchanger shown in FIG. 2 taken along sectional line 3—3.
Figure 4:
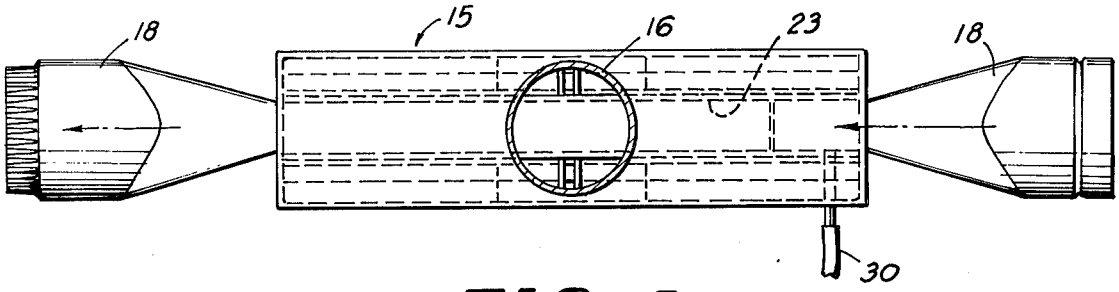
FIG. 4 is a side elevational view of the side of the heat exchanger shown in FIG. 1 opposite that illustrated in FIG. 2.
Figure 5:
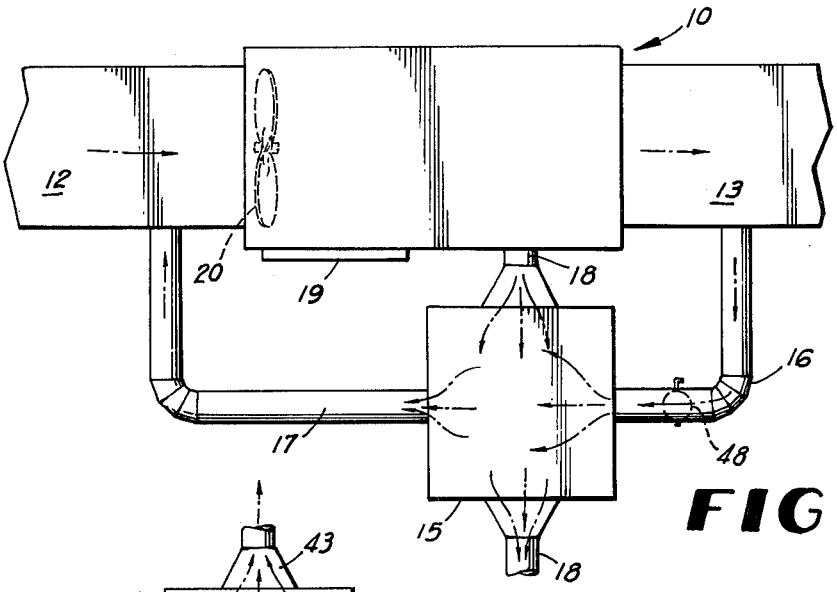
FIG. 5 is a plan view of the heat recovery system shown in FIG. 1.

With particular reference now to FIGS. 2 and 3, heat exchanger 15 is seen in more detail to comprise a shell or outer casing 22 of sheet metal mounted to conduits 16 and 17 in which is housed an inner casing 23 of sheet metal. The inner casing itself is mounted at each end to flaring ends of flues 18 with its top 23 and bottom 26 disposed in spaced relation with the inside of the outer casing. A set of angle irons 28 is mounted to an inner casing top 23 and bottom 26. A drain 30 extends from bottom 26 down through the outer casing.

The heat exchanger is further provided with a pair of arcuate vanes 32 mounted to floor 26 of the inner casing for deflecting air evenly therethrough. Similarly, two pairs of arcuate vanes 33 are mounted to the outside top and bottom of the inner casing to deflect air evenly over the inner casing through the passageways provided between the inner and outer casings, respectively. The flaring of flues 18 adjacent their connection with the heat exchanger further aids in evening the flow of flue gases through the exchanger. After the air passing over and below the inner casing has been evenly distributed by vanes 33 it is made turbulent by the presence of the angle irons 28 that are mounted to the top and bottom of the inner casing normally the direction of air flow thereover. Thus, though the distribution of air flow is even it nevertheless is turbulent for enhanced heat transfer.

In operation the furnace is ignited in conventional fashion and blower 20 energized forcing air to be drawn through air return duct 12, furnace 10 and supply air duct 13. The hot flue gases are drawn out through flue 18 through the heat exchanger. The differential in pressure created by the blower causes a portion of the air exhausted from the furnace to be drawn through conduit 16 through the heat exchanger in heat transfer relation with the hot flue gases being drawn from the furnace through flues 18. The temperature of the air passing through the heat exchanger is thereby elevated which air is then directed through conduit 17 back to the air return duct 12. The speed at which air is drawn through the heat exchanger is relatively large since both the drawing action of the blower as well as its propelling action is applied to this flow of air.

Figure 6:
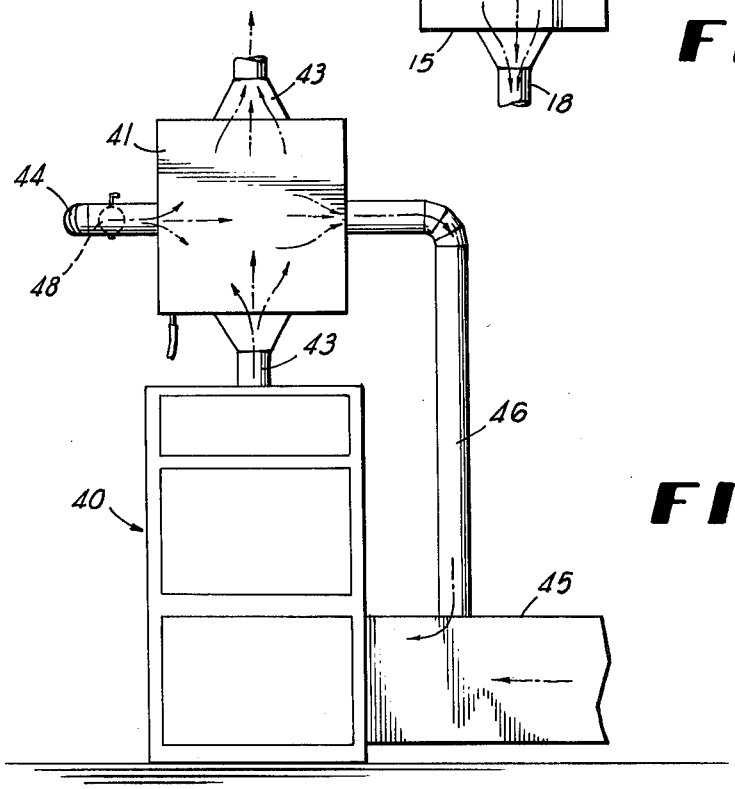
FIG. 6 is a heat recovery system embodying principles of the invention in an alternative form from that illustrated in FIGS. 1 and 5.

In the just described embodiment it should be noted that the heat exchanger, conduits 16 and 17 and flues 18 all along a generally horizontal plane laterally aside the furnace itself. This however is optional with the present system. Thus, in FIG. 6 the furnace 40 is seen to be located beneath a heat exchanger 41 of the type just described with flues 43 extending vertically between the furnace and exchanger. A conduit 44 provides fluid communication between an unshown air supply duct and a conduit 46 provides communication between the heat exchanger and air return duct 45. A damper 48 is provided in conduit 44 as well as in conduit 16 of the previously described embodiment to provide means for shutting off the draw of air feed back through the heat exchanger when the furnace is not being operated.

We thus see that a heat recovery system for a forced air furnace is provided which may be mounted with relative ease to furnaces that have previously been installed in homes or commercial buildings as well as in those heating systems being newly erected. The heat exchanger itself is of relatively simple but efficient construction requiring minimal servicing due particularly to its complete lack of moving parts. It has been found that efficiencies of furnaces utilizing the just described heat recovery system is increased approximately 9%. This is indeed surprising in view of the fact that the air routed from the supply duct through the heat exchanger is at a higher temperature than air drawn from ambient as in the prior art systems. Thus through the present invention it has been discovered that the increase in speed at which air is drawn through the duct system enhances heat transfer substantially more than that offset by the transfer loss occasioned by the elevated temperature of the air directed through the exchanger. Conduit 16 may, of course, by connected between the blower and furnace to avoid even this increase in temperature, but such a connection is relatively difficult to make due to the normally close proximity of the blower and furnace.

In one test air at standard room temperture was drawn into a 80,000 BTU per hour furnace having 5 inch diameter flues and 6 inch diameter conduits between the furnace air ducts and exchanger. The supply air was observed to be a temperature of 108° F. The flue gases were found to flow at a velocity of 50 feet per minute and to be at a temperature of 420° F approaching the heat exchanger and a temperature of 240° F upon exhaust to the atmosphere. Approximately 156 cubic feet per minute were found to flow between the furnace air ducts through the exchanger. The temperature of the air passing through the exchanger was observed to be increased from 108° F to 154° F. This provided quantitive heat recovery calculated at 7,750 BTU per hour.

It should be understood that the just described embodiments are only representative of preferred forms of the invention. Many other modifications, additions and deletions may, of course, be made thereto without departure from the spirit or scope of the invention as set forth in the following claims.

What is claimed is:

1. A heat recovery system for a forced air furnace having a flue through which combusted gases are exhausted from the furnace, an in line series of air ducts connected with the furnace including a return air duct through which air is drawn into the furnace for heating and a supply air duct through which heated air is blown from the furnace, and a blower means for forcing air through the in line series of ducts and the furnace, said heat recovery system comprising a heat exchanger having a size and capacity sufficient only to receive a portion of the heated air extracted from the supply air duct and pass it in heat transfer relationship with combusted gases exhausting through said flue, a first conduit of comparatively small cross section in relation to said air ducts and coupled in said supply air duct and also coupled into a first chamber of said heat exchanger, a second conduit of like cross sectional size with the first conduit and coupled into said first chamber of the heat exchanger and into said return air duct, the first and second conduits and heat exchanger and said flue disposed in a common horizontal plane with said in line series of air ducts with the heat exchanger coupled across said blower means by said first and second conduits, said flue being coupled with a second chamber of the heat exchanger across the axes of said in line series of air ducts and said first and second conduits in said common horizontal plane, and said heat exchanger comprising inner and outer casings with the inner casing defining said first heat exchanger chamber and the outer casing defining said second heat exchanger chamber in communication with said flue, said second heat exchanger chamber completely surrounding and separated from the first heat exchanger chamber.

2. A heat recovery system as defined in claim 1, wherein said heat exchanger is a vertically shallow box-like unit connected at its opposite ends and opposite sides respectively with said first and second conduits and said flue and having a vertical height only slightly exceeding the cross sectional widths of said conduit and flue and being narrow vertically in comparison to said air ducts.

3. A heat recovery system as defined in claim 1, and a condensate drain on said heat exchanger connected in the inner casing thereof and communicating with the inner chamber of the heat exchanger.

4. A heat recovery system as defined in claim 1, and sets of directional vanes in the first and second chambers of the heat exchanger adjacent their inlet connections with the first conduit and flue.

5. A heat recovery system as defined in claim 4, and turbulence inducing baffles on the outer surface of the inner casing of the heat exchanger and projecting into said second heat exchanger chamber.

* * * * *